US008373358B2

(12) United States Patent
Hsu et al.

(10) Patent No.: US 8,373,358 B2
(45) Date of Patent: Feb. 12, 2013

(54) COMPACT AND EFFICIENT DRIVER FOR MULTIPLE LIGHT EMITTING DIODES (LEDS)

(75) Inventors: Issac Kuan-Chun Hsu, North Point (HK); Hok-Sun Ling, Fanling (HK)

(73) Assignee: National Semiconductor Corporation, Santa Clara, CA (US)

( * ) Notice: Subject to any disclaimer, the term of this patent is extended or adjusted under 35 U.S.C. 154(b) by 276 days.

(21) Appl. No.: 12/800,755

(22) Filed: May 21, 2010

(65) Prior Publication Data

US 2011/0285318 A1 Nov. 24, 2011

(51) Int. Cl.
*H05B 37/02* (2006.01)

(52) U.S. Cl. ..... 315/291; 315/297; 315/308; 315/312

(58) Field of Classification Search ..... 315/185 R, 315/186, 291, 294, 297, 307, 308, 312
See application file for complete search history.

(56) References Cited

U.S. PATENT DOCUMENTS

| | | | |
|---|---|---|---|
| 5,396,188 | A | 3/1995 | Aoki |
| 5,420,499 | A | 5/1995 | DeShazo |
| 6,084,465 | A | 7/2000 | Dasgupta |
| 6,239,654 | B1 | 5/2001 | Yamamoto |
| 6,583,609 | B1 | 6/2003 | Pardoen |
| 6,606,257 | B2 | 8/2003 | Bourdillon |
| 6,683,419 | B2 | 1/2004 | Kriparos |
| 6,784,728 | B2 | 8/2004 | Fischer |
| 6,844,760 | B2 | 1/2005 | Koharagi et al. |
| 6,871,289 | B2 | 3/2005 | Pullen et al. |
| 7,058,373 | B2 | 6/2006 | Grigore |
| 7,115,888 | B2 | 10/2006 | Hachiya et al. |
| 7,132,820 | B2 | 11/2006 | Walters et al. |

(Continued)

FOREIGN PATENT DOCUMENTS

| | | |
|---|---|---|
| JP | 2007036167 | 2/2007 |
| JP | 2008059811 | 3/2008 |

(Continued)

OTHER PUBLICATIONS

"LM3402/LM3402HV, 0.5A Constant Current Buck Regulator for Driving High Power LEDs", National Semiconductor Corporation, Dec. 2, 2008, 24 pages.

(Continued)

*Primary Examiner* — Tung X Le
(74) *Attorney, Agent, or Firm* — William B. Kempler; Wade J. Brady, III; Frederick J. Telecky, Jr.

(57) ABSTRACT

A method includes receiving a variable reference voltage at a power converter and generating a regulated output voltage based on the variable reference voltage. The method also includes sequentially driving multiple sets of light emitting diodes (LEDs) using the regulated output voltage, where each set includes at least one LED. The variable reference voltage varies based on the set of LEDs being driven. For example, the method could include receiving a first reference voltage, generating a first output voltage based on the first reference voltage, and driving a first set of LEDs using the first output voltage. The method could then include receiving a second reference voltage, generating a second output voltage based on the second reference voltage, and driving a second set of LEDs using the second output voltage. At least one additional set of LEDs could be driven concurrently with the sequential driving of the multiple sets of LEDs.

14 Claims, 6 Drawing Sheets

U.S. PATENT DOCUMENTS

| | | | | |
|---|---|---|---|---|
| 7,221,134 | B1 | 5/2007 | Ling | |
| 7,388,359 | B1 | 6/2008 | Ling | |
| 7,425,819 | B2 | 9/2008 | Isobe | |
| 7,443,209 | B2 | 10/2008 | Chang | |
| 7,579,819 | B1 | 8/2009 | Ling | |
| 7,595,622 | B1 | 9/2009 | Tomiyoshi et al. | |
| 7,671,573 | B1 | 3/2010 | Ling et al. | |
| 2007/0132439 | A1 | 6/2007 | Tsuzaki | |
| 2007/0236155 | A1 | 10/2007 | Kao et al. | |
| 2009/0122003 | A1 | 5/2009 | Chen et al. | |
| 2009/0128045 | A1* | 5/2009 | Szczeszynski et al. | 315/185 R |
| 2009/0267573 | A1 | 10/2009 | Chien et al. | |
| 2010/0026203 | A1* | 2/2010 | Zhao et al. | 315/291 |
| 2010/0148679 | A1* | 6/2010 | Chen et al. | 315/185 R |
| 2010/0194308 | A1* | 8/2010 | Zhao et al. | 315/297 |
| 2011/0018450 | A1* | 1/2011 | Hsu et al. | 315/185 R |
| 2011/0043118 | A1* | 2/2011 | Joo et al. | 315/185 R |

FOREIGN PATENT DOCUMENTS

| | | |
|---|---|---|
| JP | 2008277079 | 11/2008 |

OTHER PUBLICATIONS

"LM3404/04HV, 1.0A Constant Current Buck Regulator for Driving High Power LEDs", National Semiconductor Corporation, Dec. 2, 2008, 24 pages.

"Simple Switcher® Synchronous 1MHz 1.5A Step-Down Voltage Regulator", National Semiconductor Corporation, Dec. 1, 2009, 18 pages.

Tawen Mei, et al., "Circuit and Method for Average-Current Regulation of Light Emitting Diodes", U.S. Appl. No. 11/703,981, filed Feb. 8, 2007.

"PWM LED Driver and Boost, Flyback and SEPIC Controller", Linear Technology Corporation 2005, 24 pages.

"Constant Current LED Driver with Digital and PWM Brightness Control", Texas Instruments, Nov. 2004, 25 pages.

Prathyusha Narra, et al., "An Effective LED Dimming Approach", 2004 IEEE, p. 1671-1676.

T. Suntio et al., "Dynamic Effects of Inductor Current Ripple in Average Current Mode Control", 2001 IEEE, pp. 1259-1264.

Zaohong Yang et al., "DC-To-DC Buck Converters with Novel Current Mode Control", 1999 IEEE, pp. 1158-1164.

Lik-Kin Wong, et al., "On/Off Time Modulation for Constant On-Time and Constant Off-Time Switching Regulators", U.S. Appl. No. 12/658,021, filed Feb. 1, 2010.

Lawrence Hok-Sun Ling, "System and Method for Providing a Pulsating Current Output Having Ultra Fast Rise and Fall Times", U.S. Appl. No. 11/731,961, filed Apr. 2, 2007.

PCT Search Report mailed Feb. 9, 2012.

* cited by examiner

| FIG. 1A | FIG. 1B |
|---|---|

| FIG. 4A | FIG. 4B |
|---|---|

COMPACT AND EFFICIENT DRIVER FOR MULTIPLE LIGHT EMITTING DIODES (LEDS)

TECHNICAL FIELD

This disclosure is generally directed to light emitting diode (LED) systems. More specifically, this disclosure relates to a compact and efficient driver for multiple LEDs.

BACKGROUND

Many systems use light emitting diodes (LEDs) to generate light. For example, LEDs are often used in display devices to generate red, green, and blue light. Each color could be generated using one or more strings of LEDs, where each string can include multiple LEDs coupled in series. Often times, LED strings are driven sequentially, where one string is turned on and off and then the next string is turned on and off (usually without overlap).

Conventional devices operating in this manner can include a power converter that uses a fixed reference voltage to generate a fixed output voltage for the LED strings. Conventional devices can also include a linear regulator for each LED string. The linear regulator compares (i) a reference voltage for its LED string and (ii) a sense voltage generated by a sense resistor coupled in series with the LEDs in its string. The linear regulator typically controls a pass transistor coupled in series with the LEDs in its string.

This approach, however, is not particularly efficient. Linear regulators often require a voltage overhead so that the pass transistor operates in a gain region. Also, the voltage regulator generates a fixed output voltage regardless of the LED string being driven. These and other issues can cause large power losses. The worst case efficiency of a typical LED driver could be around 65%.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 5, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figures 1, 1A:
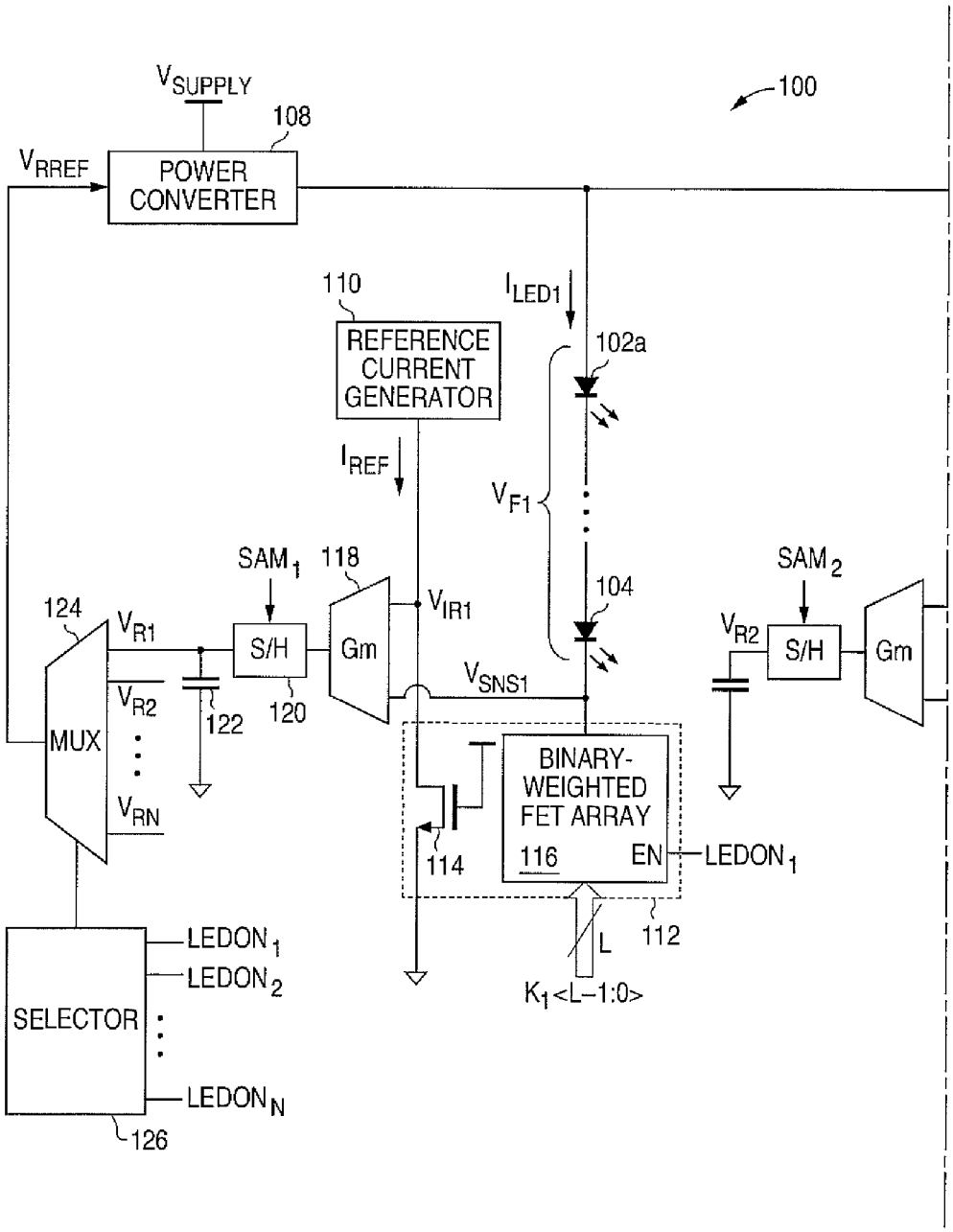
FIG. 1 illustrates an example driving system for multiple light emitting diodes (LEDs) according to this disclosure.
Figure 1B:
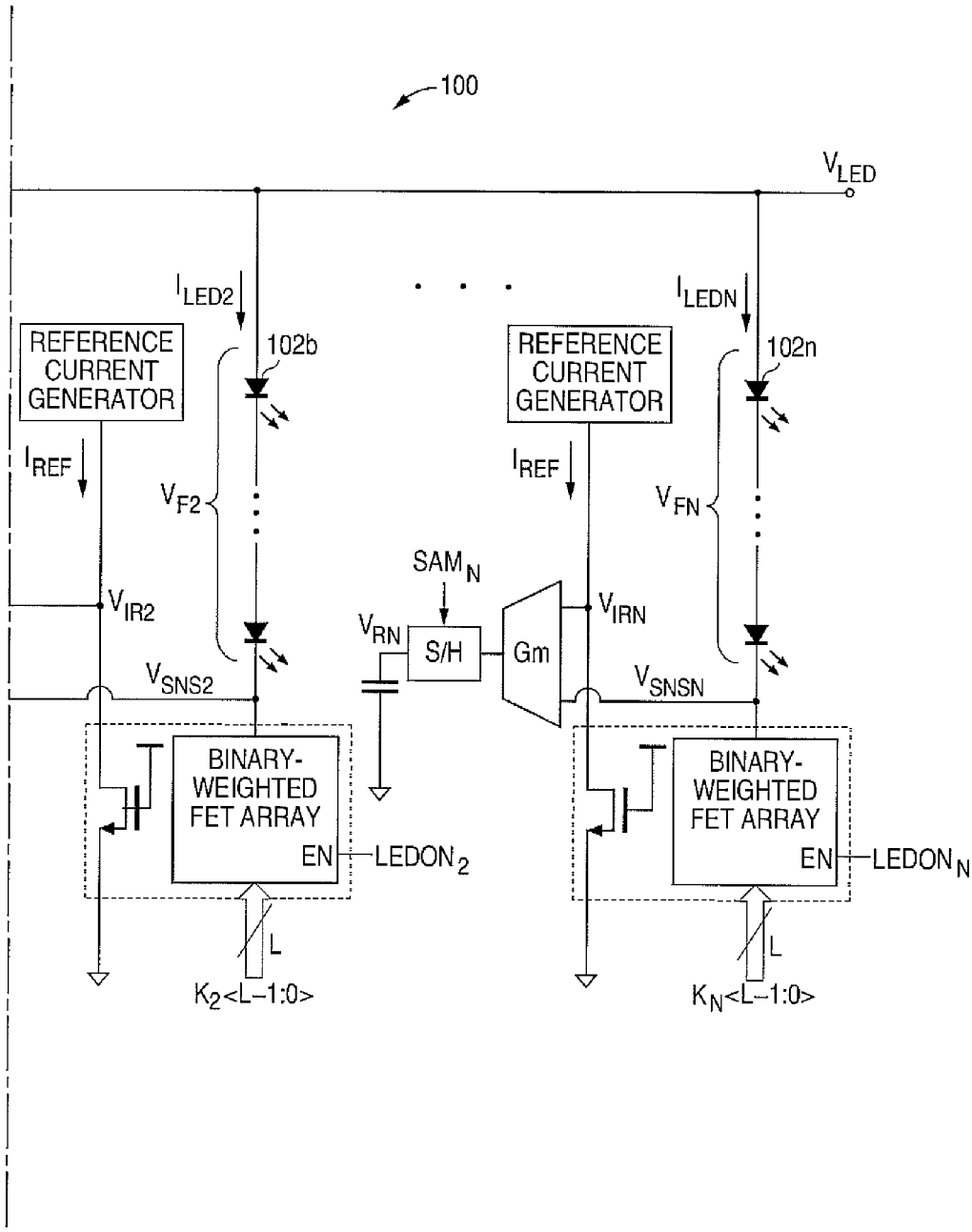

FIG. 1 illustrates an example driving system 100 for multiple light emitting diodes (LEDs) according to this disclosure. In this example, the driving system 100 includes or is used in conjunction with multiple LED strings 102*a*-102*n*.

Each LED string 102*a*-102*n* here includes multiple LEDs 104. Each LED 104 represents any suitable semiconductor structure for generating light. The LEDs 104 could generate any suitable type of illumination, such as red, green, and blue light. In this example, each string 102*a*-102*n* includes multiple LEDs 104 that are coupled in series, and the strings 102*a*-102*n* are coupled in parallel. However, any other configuration involving the serial and/or parallel connection of multiple LEDs 104 to form a string could be used. Also, a string could include a single LED 104, and strings with one or multiple LEDs could be placed in any suitable arrangement.

The system 100 includes a power converter 108. The power converter 108 uses a supply voltage $V_{SUPPLY}$ and a variable reference voltage $V_{RREF}$ to generate a regulated direct current (DC) output voltage $V_{LED}$. This causes currents $I_{LED1}$-$I_{LEDN}$ to flow through the LED strings 102*a*-102*n*, driving the LED strings 102*a*-102*n*. The power converter 108 includes any suitable structure for converting supply voltages in any form (including AC or DC voltages) to DC voltage. The power converter 108 can be capable of both sourcing and sinking current.

In this example, each LED string 102*a*-102*n* is associated with circuitry for controlling the current flowing through that LED string. For ease of explanation, this circuitry is described with respect to the LED string 102*a*. The same or similar circuitry could be used with each of the other LED strings 102*b*-102*n*.

A reference current generator 110 generates a reference current $I_{REF}$. In this embodiment, the reference current $I_{REF}$ is the same for each LED string 102*a*-102*n*. However, different reference currents could also be used. The reference current generator 110 includes any suitable structure for generating a reference current.

The reference current $I_{REF}$ is provided to a matched transistor network 112. More specifically, the reference current $I_{REF}$ flows through a reference transistor 114 in the matched transistor network 112. The reference transistor 114 has an "on" resistance $R_{REF}$, and the reference current $I_{REF}$ generates an internal reference voltage $V_{IR1}$ based on that resistance $R_{REF}$.

The matched transistor network 112 also includes a binary-weighted transistor array 116. The transistor array 116 can provide a variable sense resistance $R_{SNS1}$ defined by the "on" resistance of one or more transistors in the array 116. The transistor array 116 could have the form shown in FIG. 2, where multiple transistors 202*a*-202*n* are coupled in parallel. Each transistor 202*a*-202*n* is controlled by one bit of an L-bit control signal ($K_n$<L−1> through $K_n$<0>). The transistors 202*a*-202*n* have "on" resistances that decrease in a binary fashion. The transistor 202*a* could have a resistance denoted x1, and the transistor 202*b* could have half the resistance denoted x½. The transistor 202*m* could have a resistance denoted $x\frac{1}{2}^{L-2}$, and the transistor 202*n* could have a resistance denoted $x\frac{1}{2}^{L-1}$. With L transistors 202*a*-202*n*, $2^L$ different resistances can be created in the transistor array 116 (including an open circuit when all transistors are turned off). The current $I_{LED1}$ in the string 102*a* may approximately equal the reference resistance $R_{REF}$ divided by the sense resistance $R_{SNS1}$ times the reference current $I_{REF}$. As a result, increasing the sense resistance $R_{SNS1}$ can decrease the LED current $I_{LED1}$, thereby reducing a brightness of the LED string 102*a* and vice versa. In some embodiments, the resistance of the transistor 202*a* matches the resistance of the reference transistor 114.

The transistor array 116 is also controlled by an enable signal $LEDON_1$. The enable signal $LEDON_1$ indicates whether the LED string 102*a* is being driven or is currently turned off. If disabled, the enable signal $LEDON_1$ could cause all transistors 202*a*-202*n* in the transistor array 116 to open, creating an open circuit below the LED string 102*a*. If enabled, at least one of the transistors 202*a*-202*n* in the transistor array 116 can be closed, and the LED current $I_{LED1}$ generates a sense voltage $V_{SNS1}$ across the sense resistance $R_{SNS1}$. The enable signal $LEDON_1$ can also have a specified duty cycle in order to provide pulse width modulation (PWM) dimming control.

The matched transistor network 112 includes any suitable number of transistors for providing reference and sense resistances. The transistors 114, 202*a*-202*n* can represent any suitable transistor devices, such as n-channel metal oxide semiconductor (NMOS) transistors. Internal reference voltages $V_{IR2}$-$V_{IRN}$ and sense voltages $V_{SNS2}$-$V_{SNSN}$ can be generated in the other LED strings 102*b*-102*n* in the same or similar manner using enable signals $LEDON_2$-$LEDON_N$.

The internal reference voltage $V_{IR1}$ and the sense voltage $V_{SNS1}$ are provided to a transconductance amplifier (Gm) 118, which amplifies a difference between the voltages and generates an output current. The output current is provided to a sample and hold circuit (S/H) 120, which samples its input current and outputs the sampled current. The sample and hold circuit 120 can capture a sample of its input current in response to a control signal $SAM_1$. The sampled current that is output by the sample and hold circuit 120 is provided to a capacitor 122, which stores a reference voltage $V_{R1}$. The transconductance amplifier 118 includes any suitable structure for generating a current based on a difference in input voltages, such as an amplifier with a high loop gain. The sample and hold circuit 120 includes any suitable structure for sampling a signal and outputting a sampled value. The capacitor 122 includes any suitable capacitive structure having any suitable capacitance. Note that while a capacitor 122 is shown here as storing a voltage, any other suitable voltage storage element could be used, such as an analog-to-digital converter coupled to a digital register.

As shown here, the driving system 100 can generate multiple reference voltages $V_{R1}$-$V_{RN}$, each of which denotes the error between the desired current through the LEDs in a string and the actual current through those LEDs. The reference voltages $V_{R1}$-$V_{RN}$ are fed back to the power converter 108 as the variable reference voltage $V_{RREF}$. A multiplexer 124 selects which of the reference voltages $V_{R1}$-$V_{RN}$ is provided as the reference voltage $V_{RREF}$. For example, the LED strings 102*a*-102*n* could be driven sequentially, such as by driving the string 102*a* with the enable signal $LEDON_1$ and then driving the string 102*b* with the enable signal $LEDON_2$ (without overlap between the driving of the strings 102*a*-102*b*). The multiplexer 124 could output the reference voltage $V_{R1}$-$V_{RN}$ that is associated with the particular LED string being driven. This allows the power converter 108 to operate using different reference voltages, depending on the LED string being driven.

The multiplexer 124 is controlled by a selector 126. The selector 126 uses the enable signals $LEDON_1$-$LEDON_N$ to identify which reference voltage $V_{R1}$-$V_{RN}$ should be output by the multiplexer 124. The selector 126 then generates one or more control signals for the multiplexer 124, where those control signals cause the multiplexer 124 to output the appropriate reference voltage. The multiplexer 124 includes any suitable structure for receiving multiple input signals and selectively outputting at least one of the input signals. The selector 126 includes any suitable structure for generating at least one control signal for a multiplexer.

When the driving system 100 first starts or is otherwise initialized, an external controller can cause the driving system 100 to drive each LED string 102*a*-102*n* once sequentially. As each string is driven, its reference voltage $V_{R1}$-$V_{RN}$ reaches a suitable value, which can be stored on the capacitor 122. After that, whenever the driving system 100 attempts to drive an LED string, the multiplexer 124 can output the voltage from that string's capacitor 122 as the reference voltage $V_{RREF}$. This allows the power converter 108 to immediate change its output voltage $V_{LED}$ in accordance with each LED string's reference voltage $V_1$-$V_{RN}$.

In this manner, the driving system 100 can selectively provide different reference voltages to the power converter 108 as a reference voltage $V_{RREF}$. The different reference voltages are associated with different LED strings 102*a*-102*n*. The use of different reference voltages may allow the LED currents $I_{LED1}$-$I_{LEDN}$ to have very fast slew rates (such as ten or several tens of microseconds), allowing well-defined current pulses to be created. This also allows the power converter 108 to generate a voltage $V_{LED}$ that can vary depending on the forward voltage $V_{F1}$-$V_{FN}$ of the LED string currently being driven. Further, dimming control can be supported through the $LEDON_1$-$LEDON_N$ signals and the transistor arrays 116 can be altered using the control signals $K_1$-$K_N$, allowing the LED currents $I_{LED1}$-$I_{LEDN}$ to be adjusted dynamically. All of this can be accomplished using a single power converter 108, which reduces the size and cost of the driving system 100. This can also help to reduce the voltage required to drive the LEDs 104 while still preserving current programmability, and the driving system 100 can be highly efficient (such as up to 93% efficient or even more).

Note that this functionality could be used in a wide variety of devices or systems. For example, the driving system 100 could be used in projector systems, display devices, emergency signal lights, or other devices in which strings of LEDs are sequentially illuminated (such as to generate different colors).

Figure 2:
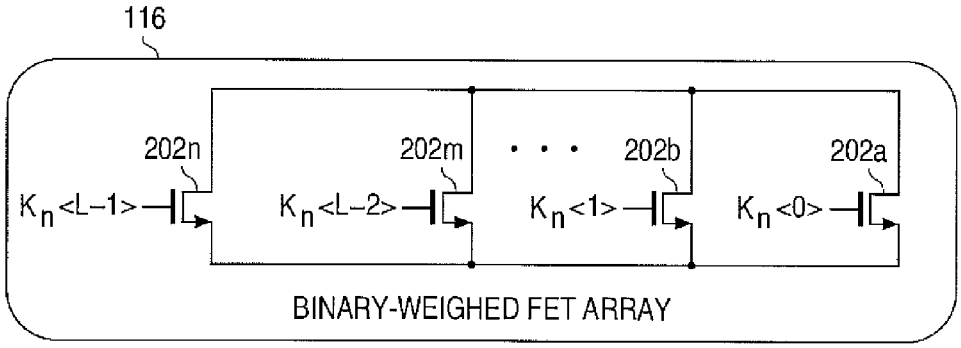
FIG. 2 illustrates an example binary-weighted transistor array in an LED driving system according to this disclosure.

Although FIG. 1 illustrates one example of a driving system 100 for multiple LEDs, various changes may be made to FIG. 1. For example, the system 100 could drive any suitable number of LED strings, each of which could include any suitable number of LEDs. Also, while FIG. 1 illustrates the use of specific circuitry to perform certain functions, other circuitry could be used to perform the same or similar functions. Although FIG. 2 illustrates one example of a binary-weighted transistor array 116 in an LED driving system, various changes may be made to FIG. 2. For instance, the transistor array 116 could include any number of transistors in any suitable configuration, and any suitable type(s) of transistors could be used.

Figure 3:
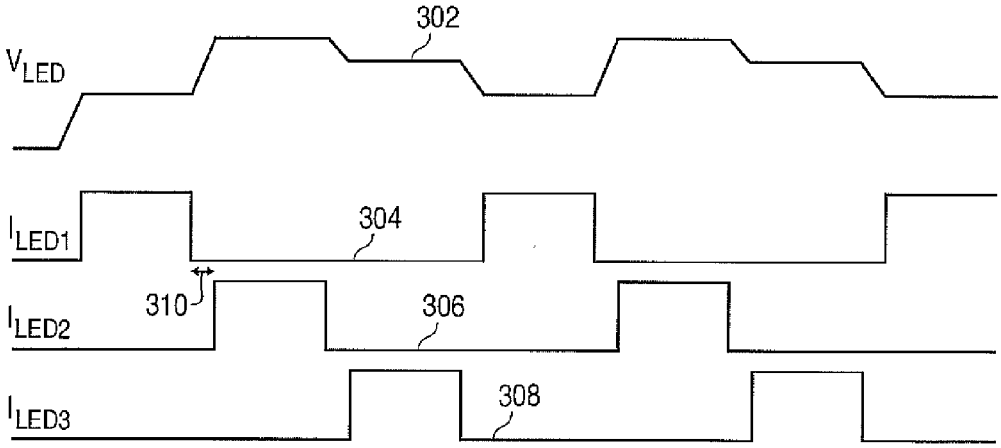
FIG. 3 illustrates example waveforms associated with the driving system of FIG. 1 according to this disclosure.

FIG. 3 illustrates example waveforms associated with the driving system 100 of FIG. 1 according to this disclosure. In FIG. 3, a waveform 302 denotes the output voltage $V_{LED}$ from the power converter 108, and waveforms 304-308 denote LED currents $I_{LED1}$-$I_{LED3}$ through three LED strings. The LED currents $I_{LED1}$-$I_{LED3}$ may or may not be equal. As can be seen in FIG. 3, the output voltage $V_{LED}$ varies over time as the multiplexer 124 outputs different reference voltages $V_{R1}$-$V_{RN}$ as the reference voltage $V_{RREF}$. Moreover, the LED currents $I_{LED1}$-$I_{LED3}$ have clearly defined pulses with rapid slew rates. In particular embodiments, each LED current $I_{LED1}$-$I_{LED3}$ could range from 0 A to about 2 A with a slew rate of about 1 μs.

Also as shown in FIG. 3, there could be a dead time 310 between the end of a pulse in one current (here $I_{LED1}$) and the beginning of a pulse in another current (here $I_{LED2}$). This dead time 310 could represent any suitable amount of time, such as about 40 μs. Among other things, this dead time 310 may allow the multiplexer 124 to switch outputs and the power converter 108 to begin generating an appropriate output voltage $V_{LED}$. Note, however, that the driving system 100 could be modified so that pulses in the LED currents overlap as described below.

Although FIG. 3 illustrates examples of waveforms associated with the driving system 100 of FIG. 1, various changes may be made to FIG. 3. For example, the waveforms 302-308 illustrate possible operations of the driving system 100. The driving system 100 could operate in any other appropriate manner.

Figures 4, 4A:
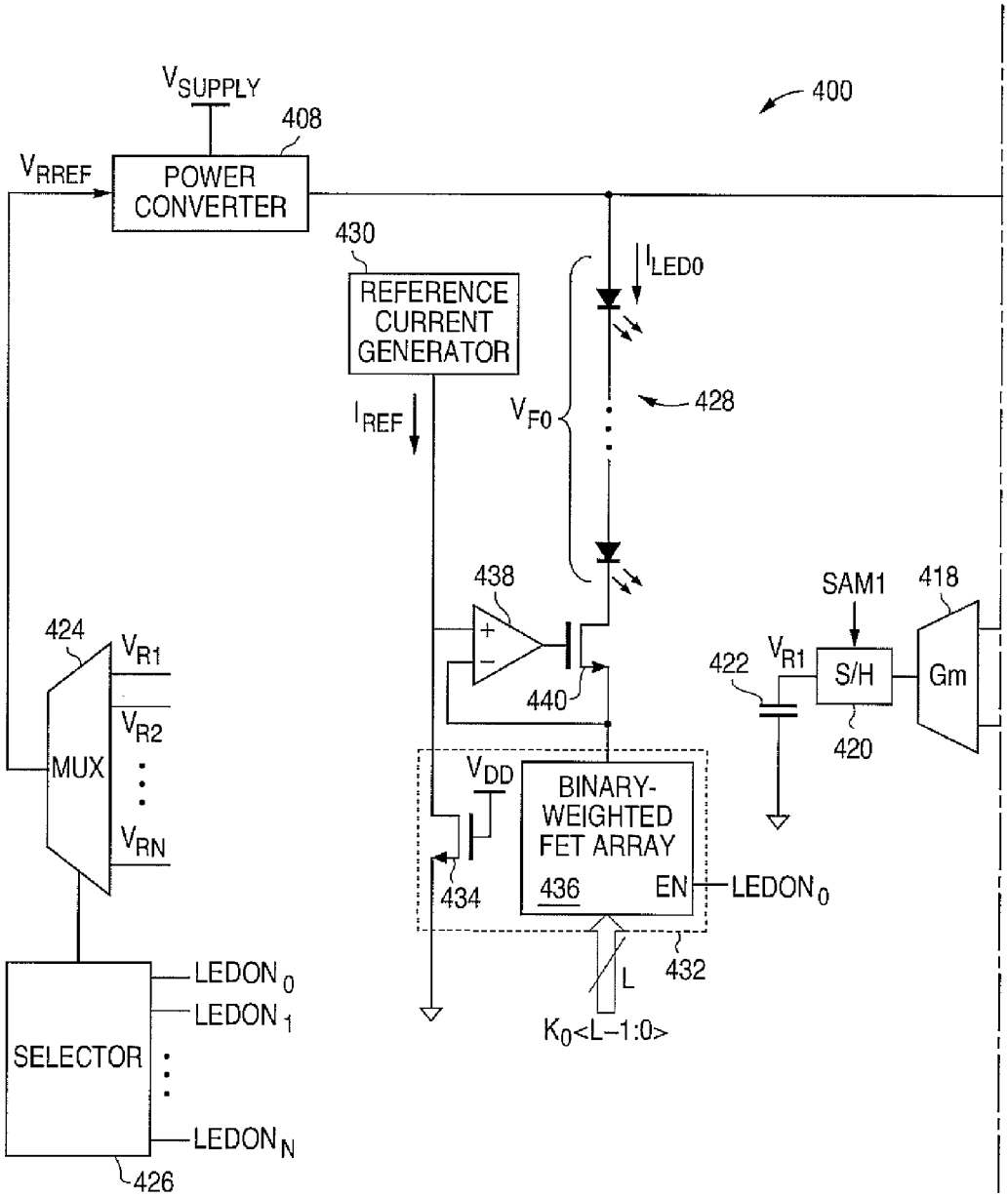
FIG. 4 illustrates another example driving system for multiple LEDs according to this disclosure.
Figure 4B:
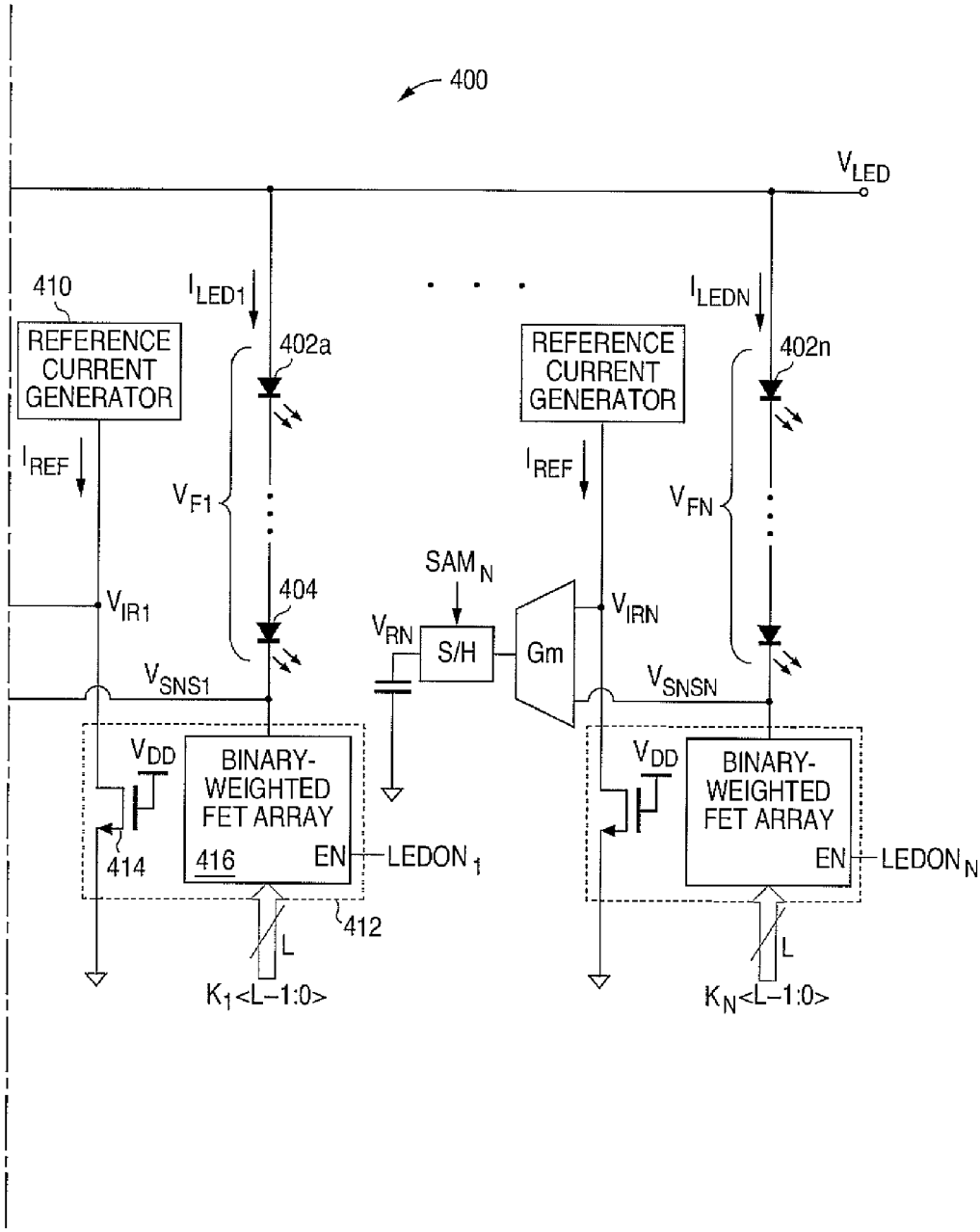

FIG. 4 illustrates another example driving system 400 for multiple LEDs according to this disclosure. As shown in FIG. 4, the driving system 400 is similar in structure to the driving system 100 of FIG. 1 and has many similar components 402*a*-426. In addition to driving the LED strings 402*a*-402*n* sequentially, at least one additional LED string 428 can be constantly driven or turned on, meaning it can be turned on while the driving system 400 is sequentially turning on and off the other LED strings 402*a*-402*n*. This could allow, for example, each LED string 428 to provide highlighting or backlighting while the other LED strings 402*a*-402*n* are driven sequentially.

In this example, each LED string 428 is associated with a reference current generator 430 and a matched transistor network 432 having a reference transistor 434 and a binary-weighted transistor array 436. The binary-weighted transistor array 436 can be enabled using an enable signal $LEDON_0$. These components may be the same as or similar to analogous components associated with the other LED strings 402*a*-402*n*. A current regulator 438 receives a reference voltage generated across the reference transistor 434 and a sense voltage generated across the transistor array 436. The current regulator 438 can represent a difference amplifier that amplifies a difference between its input voltages and controls a pass transistor 440, which is coupled in series with the LED string 428. The current regulator 438 includes any suitable structure for regulating a current, such as a linear current regulator. The pass transistor 440 includes any suitable transistor device, such as an NMOS transistor.

In particular embodiments, one or more LED strings 428 can be concurrently turned on while the other LED strings 402*a*-402*n* are being sequentially driven when one or more conditions are met. For example, an LED string 428 could be turned on if its forward voltage $V_{F0}$, together with the overhead voltage of the pass transistor 440, is lower than the lowest forward voltage $V_{F1}$-$V_{FN}$ of the LED strings 402*a*-402*n*.

Although FIG. 4 illustrates another example of a driving system 400 for multiple LEDs, various changes may be made to FIG. 4. For example, the system 400 could drive any suitable number of LEDs or LED strings. Also, while specific circuitry is shown in FIG. 4, other circuitry could be used to perform the same or similar functions. In addition, while the figures described above illustrate different driving systems with different functions or features, various functions or features implemented in one system could be used in other systems described above, and additional functions or features could be added to each system.

Figure 5:
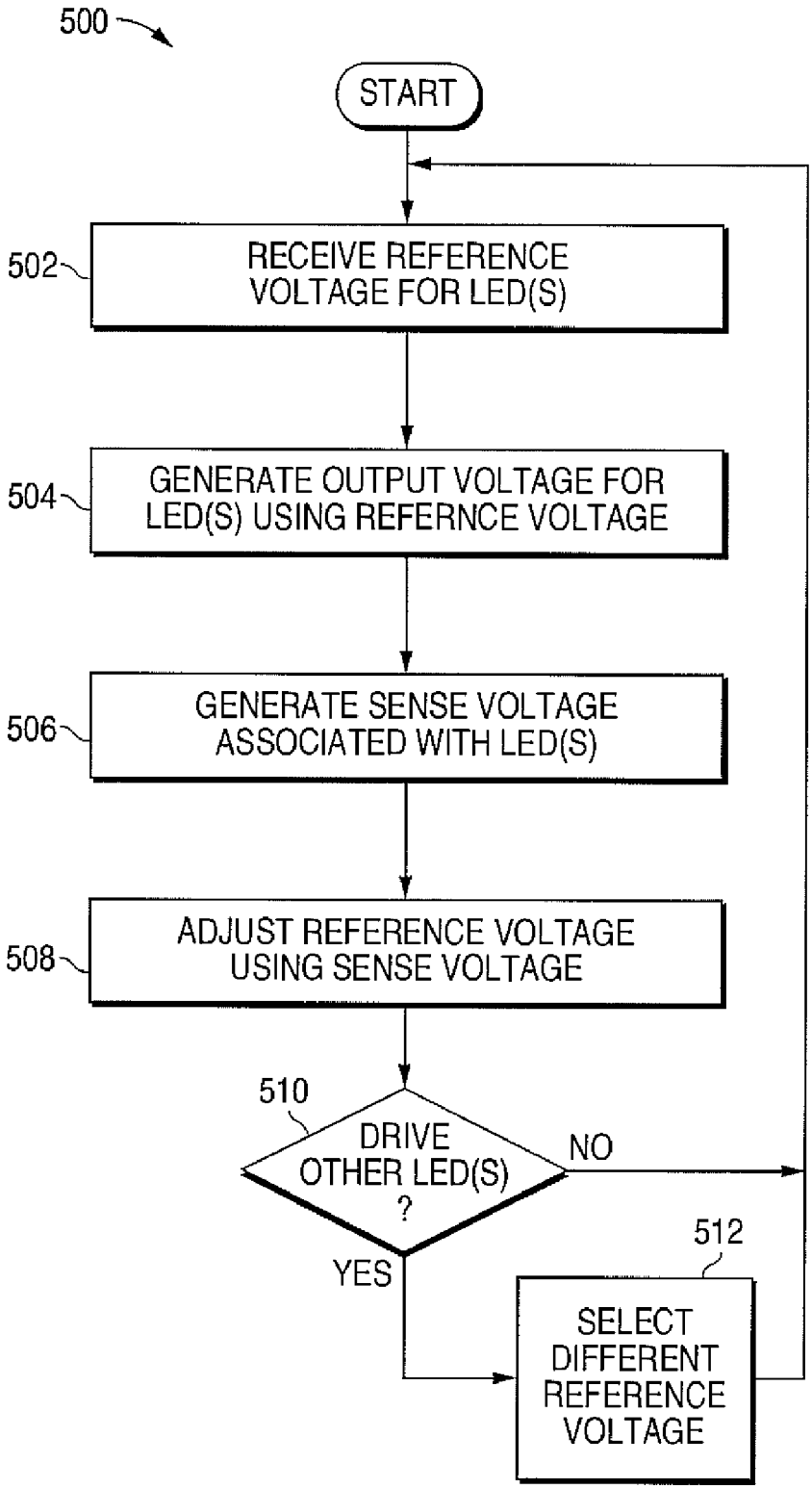
FIG. 5 illustrates an example method for driving multiple LEDs according to this disclosure.

FIG. 5 illustrates an example method 500 for driving multiple LEDs according to this disclosure. For ease of explanation, the method 500 is described with respect to the driving system 100 of FIG. 1. The method 500 could be used by any other device or system, such as the driving system 400.

As shown in FIG. 5, a reference voltage for one or more LEDs is received at step 502. This could include, for example, the power converter 108 receiving the reference voltage $V_{RREF}$ from the multiplexer 124. The reference voltage $V_{RREF}$ could be based on the voltage stored on one of the capacitors 122. The voltages on the capacitors 122 could be established during a prior initialization of the driving system 100. An output voltage for the one or more LEDs is generated at step 504. This could include, for example, the power converter 108 generating the LED voltage $V_{LED}$ based on the received reference voltage $V_{RREF}$.

A sense voltage associated with the one or more LEDs is generated at step 506. This could include, for example, closing at least one of the transistors 202*a*-202*n* in the transistor array 116 associated with the LEDs to establish a sense resistance $R_{SNSx}$. The sense resistance $R_{SNSx}$ can be adjusted to control the amount of illumination by the LEDs. The LED current $I_{LEDx}$ generates a sense voltage $V_{SNSx}$ across the sense resistance $R_{SNSx}$. The reference voltage is adjusted using the sense voltage at step 508. This could include, for example, the transconductance amplifier 118 amplifying a difference between the sense voltage and an internal reference voltage $V_{IRx}$, where the internal reference voltage $V_{IRx}$ is based on a reference current $I_{REF}$ flowing through the transistor 112. This allows, for example, the sense resistance $R_{SNSx}$ to be adjusted and the driving system 100 to adjust the reference voltage $V_{RREF}$ provided to the power converter 108 dynamically.

If there are any other LEDs to drive at step 510, a different reference voltage is selected at step 512. This could include, for example, the multiplexer 124 outputting the reference voltage of the next LED string to be driven. Otherwise, the adjusted reference voltage can continue to be used. In either case, the method returns to step 502, and steps 502-508 can be repeated (for the same LEDs or different LEDs). In this way, the method 500 can be used to drive multiple LEDs or strings of LEDs using different reference voltages. Among other things, this can help to reduce power losses in the driving system.

Although FIG. 5 illustrates one example of a method 500 for driving multiple LEDs, various changes may be made to FIG. 5. For example, while shown as a series of steps, various steps in FIG. 5 may overlap, occur in parallel, occur in a different order, or occur any number of times. Also, other features could be supported, such as when one or more LEDs are constantly driven while other LEDs are driven sequentially.

It may be advantageous to set forth definitions of certain words and phrases that have been used within this patent document. The term "couple" and its derivatives refer to any direct or indirect communication between two or more components, whether or not those components are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this invention. Other changes, substitutions, and alterations are also possible without departing from the spirit and scope of this invention as defined by the following claims.

What is claimed is:

1. A method comprising: receiving a variable reference voltage at a power converter; generating a regulated output voltage based on the variable reference voltage;

generating multiple reference voltages, each reference voltage associated with one of the sets of LEDs by for each set of LEDs:

generating an internal reference voltage based on a reference current;

generating a sense voltage based on a current flowing through that set of LEDs; and amplifying a difference between the internal reference voltage and the sense voltage;

selecting one of the multiple reference voltages as the variable reference voltage, wherein the variable reference voltage varies based on the set of LEDs being driven; and sequentially driving multiple sets of light emitting diodes (LEDs) using the regulated output voltage, each set comprising at least one LED.

2. The method of claim 1, wherein: receiving the variable reference voltage comprises receiving a first reference voltage;

generating the regulated output voltage comprises generating a first output voltage based on the first reference voltage; and driving the multiple sets of LEDs comprises driving a first set of LEDs using the first output voltage, the first set of LEDs associated with the first reference voltage.

3. The method of claim 2, wherein:

receiving the variable reference voltage further comprises receiving a second reference voltage;

generating the regulated output voltage further comprises generating a second output voltage based on the second reference voltage; and driving the multiple sets of LEDs further comprises driving a second set of LEDs using the second output voltage, the second set of LEDs associated with the second reference voltage.

4. The method of claim 1, wherein:

generating the sense voltage comprises configuring an adjustable transistor array to provide a sense resistance, the transistor array comprising multiple transistors; and generating the internal reference voltage comprises using a reference transistor having a resistance matched to a resistance of one of the multiple transistors in the transistor array.

5. The method of claim 1, further comprising:

for each set of LEDs, storing one of the reference voltages in a voltage storage element, the reference voltage based on the amplified difference.

6. The method of claim 1, wherein:

the multiple sets of LEDs comprise first sets of LEDs; and the method further comprises driving at least one second set of LEDs concurrently with the sequential driving of the first sets of LEDs.

7. The method of claim 1, wherein sequentially driving the multiple sets of LEDs comprises providing a dead time between consecutive drivings of different sets of LEDs.

8. A system comprising:

multiple sets of light emitting diodes (LEDs), each set comprising at least one LED;

a power converter configured to receive a variable reference voltage and to generate a regulated output voltage for sequentially driving the LEDs based on the variable reference voltage;

reference voltage circuitry configured to vary the variable reference voltage based on the set of LEDs being driven, wherein the reference voltage circuitry comprises:

first circuitry for generating a first reference voltage based on a current flowing through a first set of LEDs;

second circuitry for generating a second reference voltage based on a current flowing through a second set of LEDs, wherein each of the first circuitry and the second circuitry comprises:

a reference current generator configured to generate a reference current;

a matched transistor network configured to generate an internal reference voltage based on the reference current and a sense voltage based on the current flowing through the corresponding set of LEDs; and a multiplexer configured to select one of the reference voltages as the variable reference voltage.

9. The system of claim 8, wherein each of the first circuitry and the second circuitry further comprises:

an amplifier configured to amplify a difference between the internal reference voltage and the sense voltage;

a sample and hold circuit configured to sample an output of the amplifier; and a voltage storage element configured to store a voltage based on an output of the sample and hold circuit, wherein the voltage stored on the voltage storage element comprises one of the reference voltages.

10. The system of claim 8, wherein the matched transistor network comprises:

a transistor array configured to provide an adjustable sense resistance, the transistor array comprising multiple transistors; and a reference transistor having a resistance matched to a resistance of one of the multiple transistors in the transistor array.

11. The system of claim 8, wherein:

the multiple sets of LEDs comprise first sets of LEDs;

the system further comprises at least one second set of LEDs; and the system is configured to drive the at least one second set of LEDs concurrently with the sequential driving of the first sets of LEDs.

12. An apparatus comprising:

a power converter configured to receive a variable reference voltage and to generate a regulated output voltage for sequentially driving multiple sets of light emitting diodes (LEDs) based on the variable reference voltage, each set comprising at least one LED;

reference voltage circuitry configured to vary the variable reference voltage based on the set of LEDs being driven, wherein the reference voltage circuitry comprises:

first circuitry for generating a first reference voltage based on a current flowing through a first set of LEDs;

second circuitry for generating a second reference voltage based on a current flowing through a second set of LEDs, wherein each of the first circuitry and the second circuitry comprises:

a reference current generator configured to generate a reference current;

a matched transistor network configured to generate an internal reference voltage based on the reference current and a sense voltage based on the current flowing through the corresponding set of LEDs;

an amplifier configured to amplify a difference between the internal reference voltage and the sense voltage;

a sample and hold circuit configured to sample an output of the amplifier;

a voltage storage element configured to store a voltage based on an output of the sample and hold circuit, wherein the voltage stored on the voltage storage element comprises one of the reference voltages; and a multiplexer configured to select one of the reference voltages as the variable reference voltage.

13. The apparatus of claim 12, wherein the matched transistor network comprises:

a transistor array configured to provide an adjustable sense resistance, the transistor array comprising multiple transistors; and a reference transistor having a resistance matched to a resistance of one of the multiple transistors in the transistor array.

14. The apparatus of claim 12, wherein:

the apparatus is configured to sequentially drive multiple first sets of LEDs; and the apparatus is further configured to drive at least one second set of LEDs concurrently with the sequential driving of the first sets of LEDs.

* * * * *